United States Patent [19]

Lindgren

[11] 4,049,501

[45] Sept. 20, 1977

[54] DEVICE FOR SPOTTING WITHIN TOLERANCE APPARATUS ASSOCIATED WITH THE COKE OVEN CHAMBERS OF A BATTERY

[75] Inventor: Carl G. Lindgren, Pittsburgh, Pa.

[73] Assignee: Koppers Company, Inc., Pittsburgh, Pa.

[21] Appl. No.: 549,076

[22] Filed: Feb. 11, 1975

[51] Int. Cl.[2] ..... C10B 41/00; G08B 21/00

[52] U.S. Cl. ..... 202/239; 202/270; 202/262; 340/282; 33/180 R

[58] Field of Search ..... 202/262, 239, 270; 340/282, 52 R; 104/249; 214/38 BB; 258/8

[56] References Cited

U.S. PATENT DOCUMENTS

| | | | |
|---|---|---|---|
| 2,674,045 | 4/1954 | Lakomski | 33/180 R |
| 3,464,894 | 9/1969 | Tatterson | 202/262 |
| 3,734,539 | 5/1973 | Salmi | 340/282 |
| 3,754,512 | 8/1973 | Kmety | 202/262 |
| 3,906,442 | 9/1975 | Mosteller | 340/282 |

FOREIGN PATENT DOCUMENTS

| | | | |
|---|---|---|---|
| 719,324 | 12/1954 | United Kingdom | 202/262 |

*Primary Examiner*—Hiram H. Bernstein

*Attorney, Agent, or Firm*—R. Lawrence Sahr; Oscar B. Brumback

[57] ABSTRACT

An alignment bar is fixed relative to each coke oven chamber and a pivotable member mounted to apparatus movable relative to the battery engages the bar of a coke oven chamber and in so doing engages electrical contactors that regulate the movement of the apparatus. The apparatus is properly spotted within a preselected tolerance when the pivotable member breaks contact.

4 Claims, 3 Drawing Figures

DEVICE FOR SPOTTING WITHIN TOLERANCE APPARATUS ASSOCIATED WITH THE COKE OVEN CHAMBERS OF A BATTERY

BRIEF SUMMARY OF THE INVENTION

Apparatus for spotting a movable first apparatus at a chamber of a coke oven battery within a preselected tolerance includes a first member on the apparatus that carries a pivotable member. The pivotable member is engageable with an alignment bar located relative to each chamber and, when so engaged, the pivotable member engages also electrical contactors, thereby regulating the movement of the apparatus. Spotting of the apparatus is achieved when the pivotal member disengages from the electrical contactors.

For a further understanding of the invention and for features and advantages thereof, reference may be made to the following description and the drawing which illustrates a preferred embodiment of equipment in accordance with the invention.

DETAILED DESCRIPTION

Figure 1:
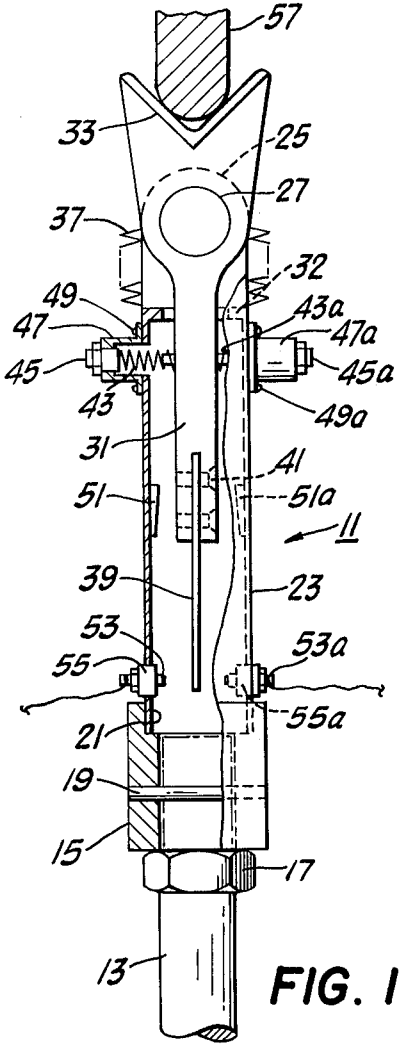
FIG. 1 is a schematic view, partly in section, of apparatus in accordance with the invention.

FIG. 1 illustrates schematically apparatus 11 for spotting a movable first apparatus, such as a coke oven door extractor device, with respect to a chamber of a coke oven battery. The apparatus 11 comprises a solid support rod 13 that is mounted to the first apparatus, say the coke oven door extractor machine (not shown), in such a way that the support rod 13 is directed toward the doors of the coke oven battery.

The free end of the support rod 13 is threaded and supports a fitting 15 threaded thereon. The fitting 15 is secured in place by a lock nut 17 and by a keeper pin 19 extending through holes in both the rod 13 and the fitting 15.

The fitting 15 is recessed as at 21 and cooperates with a tubular housing 23, which, preferably, is welded to the fitting 15, or which may be secured thereto in any other suitable manner.

Figure 2:
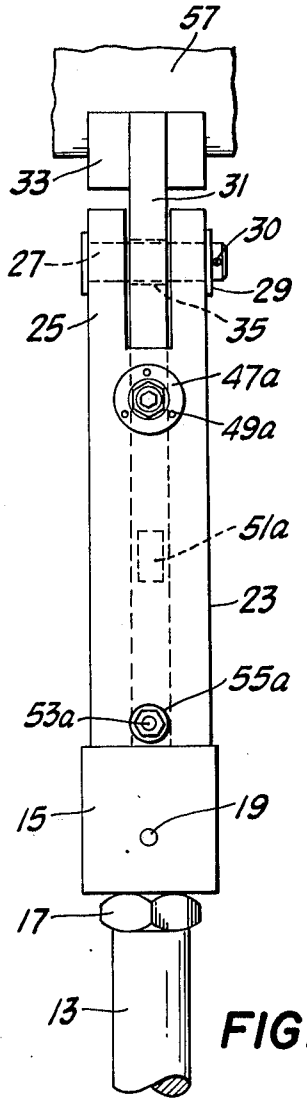
FIG. 2 is a side view of the apparatus of FIG. 1.

The tubular housing 23 has a bifurcated free end portion 25, as shown in FIG. 2, that accommodates a pin 27 extending therethrough, and that is held in place with a washer 29 and cotter pin 30, or the like. There is disposed inside the tubular housing 23, about where shown in FIG. 1, an annular member 32.

A feeler arm 31, that has an outer forked end 33, has through it, where shown, a hole and a bushing 35. The arm 31 is pivotally mounted to the tubular housing 23 on the pin 27 that extends through the bushing 35. The feeler arm 31 extends through the annular member 32 and is disposed mostly within the tubular housing 23. A flexible bellows 37 surrounds the end of the tubular housing 23 and a portion of the feeler arm 31 adjacent the housing, which keeps dust and dirt from entering the tubular housing 23.

The portion of the feeler arm 31 within the tubular housing 23 carries a thin metallic probe 39 that is fastened to the arm 31, as shown, by suitable fasteners 41.

The tubular housing 23, adjacent the free end thereof, is provided with opposed adjustable springs 43, **43*a* which abut the feeler arm 31, as shown in FIG. 1. The springs 43, 43*a* coact with adjustable plugs 45, 45*a* threaded into spring retainers 47, 47*a* that are suitably mounted as by fasteners 49, 49*a* to the tubular housing 31. The springs 43, 43*a* tend to maintain the feeler arm 31 axially aligned in the tubular housing 31**.

Figure 3:
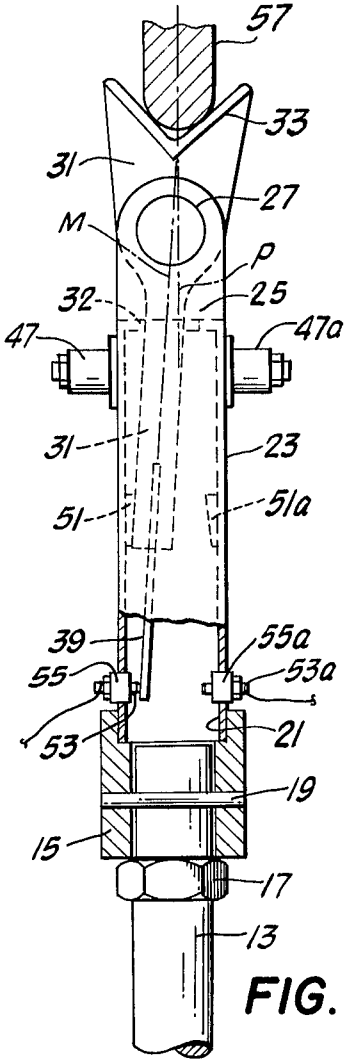
FIG. 3 is a schematic view showing the apparatus of FIG. 1 in one operative position.

Also, feeler arm stops 51, **51*a*, which are wedge-shaped, as shown, are suitably supported in opposed relation on opposite sides of the feeler arm 31. The feeler arm 31, when engaged with an alignment bar 57, mentioned hereinafter, pivots about the pin 27 and engages either one or the other stops 51 or 51*a* when the movable first apparatus is not spotted properly; FIG. 3 showing the the feeler arm 31 pivoted so as to engage the stop 51**.

Adjacent the lower end portion of the tubular housing 23, as viewed in FIGS. 1–3, there are two opposed adjustable electrical contactors 53, **53*a*. These contactors are supported also in electrically-insulated housings 55, 55*a*, and are oppositely mounted on the tubular housing 23, as shown. The free end of the thin metallic probe 39 is disposed between the contactors 59, 59*a*, and the distance between the opposed ends of the contactors is adjusted to suit a preselected "off-spot" tolerance of the door extractor machine to which the apparatus 11** is attached.

The apparatus 11 has been described herein as useful on a coke oven door extractor machine. Such description is not to be understood as limiting its utility in any sense. The apparatus 11 can be used on other movable apparatus associated with coke oven batteries well known to those skilled in the art.

The door extractor machine is selected because it is a typical piece of movable apparatus associated with a coke oven battery for illustrative purposes only.

When it is determined that coke in a coke oven chamber is to be "pushed", the door extractor machine moves from a remote location along the coke oven battery toward the oven to be pushed and it stops opposite such oven. Then, as the door extractor head on the machine moves toward the oven door, the forked end 33 of the feeler arm 31 contacts the alignment bar 57 mentioned previously, which is fixed at a preselected location relative to the oven to be pushed. Such an alignment bar would be located in the same relative position at each oven chamber.

If perchance the door extractor machine is spotted properly within a preselected spotting tolerance, as suggested in FIG. 1, the feeler arm 31 contacts the alignment bar as shown. The feeler arm 31 does not pivot enough about the pin 27 (being restrained somewhat by the springs 43, **43*a*) to cause the thin metallic probe 39 to contact either one of the insulated electrical contactors 53 or 53*a***. In such a situation, the door extractor machine is spotted within the preselected spotting tolerance. The door extractor head on the machine then moves toward the door, engages it, and retracts the door in the usual manner.

However, if the door extractor machine is not spotted within the preselected spotting tolerance, which is to say, it is spotted either to the right or to the left of the spot position, when the extractor head moves toward the door, the feeler arm engages the alignment bar, but in the askew position as suggested in FIG. 3. The feeler arm then pivots about the pin until the arm engages one of the stops and the probe contacts one of the electrical contactors. In FIG. 3 the angular deviation of the axis M of the feeler arm from the axis P of the alignment bar, is clearly shown.

The electrical contactors and the probe are connected in circuitry with the controls for moving the door extractor machine. Whereby, when contact is made by the probe with a contactor, the door extractor machine operator can manually actuate the machine controls, or the machine will automatically creep toward the proper spotting position.

When such contact is made with one of the contactors, the forward motion of the door extractor head stops and an indicator light or other similar device informs the door machine operator in which direction, right or left, the door machine must be moved to achieve a proper position within the spotting tolerance, as determined by the distance between the contactors 53, 53*a*.

Then, the operator can operate controls so that the door extractor machine creeps only in the direction which will achieve proper spotting conditions.

When the machine reaches the proper spotting location, the thin metallic probe, acting under the influence of the springs, no longer contacts a contactor. The operator can then cause the door extractor head to continue to move toward the door in the usual manner.

In another aspect of the invention, the proper spotting may be achieved automatically. When the metallic probe makes contact with one of the contactors, an electrical relay would be actuated to stop the machine drive motors and to energize the motors again only so that the machine would creep in the appropriate direction until the contact is released. Thus, in this case, the operator is relieved of any manual aligning duty and acts only in case of a malfunction of the equipment.

From the foregoing description of one embodiment of the invention, those skilled in the art should recognize many important features and advantages of it, among which the following are particularly significant:

That the present invention is a simple, yet effective mechanism for accurately spotting within a preselected tolerance apparatus such as a coke oven door extractor machine with the doors of a coke oven battery; and That the present invention can be operated manually or automatically to achieve proper spotting of such coke oven battery equipment.

Although the invention has been described herein with a certain degree of particularity it is understood that the present disclosure has been made only as an example and that the scope of the invention is defined by what is hereinafter claimed.

What is claimed is:

1. Apparatus for aligning a movable powered first structure with a coke oven battery at one or more preselected spotting locations and within a spotting tolerance, comprising:

a. an alignment bar mounted in a selected location on said coke oven battery;

b. a support rod mounted to said movable powered first structure and carrying a tubular housing;

c. a feeler arm pivotally mounted to said tubular housing and having a portion extending outwardly thereof and another portion extending inwardly thereof, said outwardly extending portion being adapted to coact with said alignment bar;

d. electrical contactors positioned oppositely in said tubular housing and connected in circuitry with said powered first structure; and e. means resiliently biasing said feeler arm with respect to said tubular housing.

2. The invention of claim 1 wherein:

a. said means includes a pair of springs coacting with said feeler arm and said housing.

3. The invention of claim 1 including:

a. means for advancing said support rod and tubular housing with feeler arm mounted thereto into engagement with said alignment bar whereby when said feeler arm pivots because said movable powered first structure is not properly aligned within said tolerance at a spotting location said feeler arm coacts with one of said contactors and said support rod ceases to advance.

4. The invention of claim 1 wherein:

a. said electrical contactors are spaced apart a distance that is proportional to said spotting tolerance.

* * * * *